United States Patent [19]

Weichman et al.

[11] 3,930,989

[45] Jan. 6, 1976

[54] METHOD FOR REDUCTION OF SULFUR AND NITROGEN CONTENT IN HYDROCARBONS

[75] Inventors: Bernard E. Weichman, Houston, Tex.; John H. Knight, Aurora, Colo.

[73] Assignee: The Superior Oil Company, Houston, Tex.

[22] Filed: Oct. 21, 1974

[21] Appl. No.: 516,865

[52] U.S. Cl. ..... 208/230

[51] Int. Cl.[2] ..... C10G 19/00

[58] Field of Search ..... 208/230, 234, 254, 226; 423/461; 110/1 J, 1 K; 55/316; 210/39, 40

[56] References Cited

UNITED STATES PATENTS

| | | | |
|---|---|---|---|
| 1,872,679 | 8/1932 | Chebotaref | 208/252 |
| 1,942,054 | 1/1934 | Garrison | 208/226 |
| 1,942,071 | 1/1934 | Smith | 208/226 |
| 2,412,809 | 12/1946 | Harlow | 110/1 K |
| 3,406,501 | 9/1968 | Watkins | 55/316 |
| 3,540,387 | 11/1970 | McLaren et al. | 110/1 J |
| 3,710,737 | 1/1973 | Birk | 110/1 J |
| 3,823,676 | 7/1974 | Cook et al. | 110/1 J |
| 3,850,745 | 11/1974 | Ellender | 208/226 |

OTHER PUBLICATIONS

"The Molten Carbonate Process for Sulfur Oxide Emission" 11/1969, pp. 73 to 75.

*Primary Examiner*—Delbert E. Gantz
*Assistant Examiner*—G. J. Crasanakis
*Attorney, Agent, or Firm*—Arnold, White & Durkee

[57] ABSTRACT

A method of reducing the sulfur and nitrogen content of a hydrocarbon, specifically, a liquid or gaseous phase hydrocarbon which comprises contacting the hydrocarbon with nahcolite in an amount effective to remove sulfur and nitrogen compounds from the hydrocarbon. The nahcolite containing combined sulfur and nitrogen can be removed from the hydrocarbon, producing a hydrocarbon having a reduced sulfur and nitrogen content.

The method is particularly applicable to the reduction of the sulfur and nitrogen content in shale oil by contacting shale oil and nahcolite in a shale oil retort or process.

9 Claims, No Drawings

METHOD FOR REDUCTION OF SULFUR AND NITROGEN CONTENT IN HYDROCARBONS

BACKGROUND OF THE INVENTION

1. Field of the Invention

The present invention relates to a method of reducing the sulfur and nitrogen content of a hydrocarbon product; more particularly, the present invention relates to a method of reducing the sulfur and nitrogen content of a hydrocarbon product in the liquid or gaseous phase by contact with nahcolite.

2. Description of the Prior Art

The presence of sulfur and nitrogen in combustible hydrocarbon products has long been considered a serious pollution problem since the burning of the sulfur-containing hydrocarbon produces sulfur dioxide in the flue gas and the burning of the nitrogen-containing hydrocarbon produces nitrogen oxides(s). In fact, due to the $SO_2$ and $NO_x$ (inclusive of NO and $NO_2$) pollution created by the burning of the sulfur-containing and nitrogen-containing hydrocarbons, environmental standards have been set for the maximum impurity content permissible in certain combustible hydrocarbons, e.g., sulfur content in coal, and standards are planned for maximum $NO_x$ content in flue gases.

The attempts to eliminate the pollution problem have taken many forms. For example, various and sundry compositions have been developed for scrubbing the flue gas in a hydrocarbon combustion process, so as to effectively absorb the sulfur dioxide and $NO_x$ emissions in the flue gas. In addition, it has been proposed that the addition of chemicals to the hydrocarbon product prior to combustion can eliminate the problem of excessive sulfur dioxide or $NO_x$ emissions by either binding with the sulfur or nitrogen impurities to prevent sulfur dioxide or nitrogen oxide(s) formation in the combustion process or by absorption of the sulfur dioxide and $NO_x$ formed in the combustion process prior to allowing escape in the flue gas. For example, limestone has been proposed as one such additive, and, in the area of reduction of $SO_2$ emissions from the combustion of coal, U.S. Pat. No. 3,823,676 to Cook suggests that naturally occurring Trona can serve this same function.

Contrary to these previous proposals, it has been discovered in accordance with the present invention that the sulfur and nitrogen content of a combustible hydrocarbon, and as a consequence, the sulfur dioxide and nitrogen oxides emissions upon combustion, can be reduced by contacting the hydrocarbon in the liquid or gaseous phase with an effective amount of nahcolite, a naturally occurring sodium bicarbonate, $NaHCO_3$, the nahcolite being a white monoclinic mineral.

SUMMARY OF THE INVENTION

In accordance with the present invention, it has been discovered that the sulfur and nitrogen content of a hydrocarbon containing sulfur and nitrogen impurities can be reduced by contacting the hydrocarbon in the liquid or gaseous phase prior to combustion with nahcolite in an amount effective to reduce the sulfur and nitrogen content thereof. Accordingly, upon combustion of the hydrocarbon, the sulfur dioxide and nitrogen oxide(s) emissions are appreciably reduced.

The method of the present invention is generally carried out by contacting a hydrocarbon containing sulfur and/or nitrogen impurities in the liquid or gaseous phase with nahcolite and subsequently removing the nahcolite from the hydrocarbon. While the mechanism of the present invention is not exactly known, it is assumed that the nahcolite acts to reduce the sulfur and nitrogen content of the hydrocarbon, either by a chemical reaction or absorption of the sulfur and nitrogen impurities. In either event, removal of the nahcolite from the hydrocarbon also removes the combined sulfur and nitrogen.

In a preferred embodiment of the present invention, the hydrocarbon is a shale oil and the shale oil and nahcolite are contacted in a shale oil retort. In this way, the shale oil in a gaseous or aerosol form passes through the nahcolite which has the effect of reducing the sulfur and nitrogen content of the shale oil. Alternatively, where the hydrocarbon is in the liquid phase, nahcolite in a finely divided form can be mixed with the liquid phase hydrocarbon, and upon removal by subsequent filtration, the sulfur and nitrogen content of the liquid hydrocarbon is reduced. As a further alternative, a liquid hydrocarbon containing sulfur and nitrogen impurities can be passed through a filter having nahcolite coated thereon in order to effectively reduce the sulfur and nitrogen content of the liquid phase hydrocarbon. The method of contacting may, of course, vary and those skilled in the art can easily determine other methods of achieving the desired contact between the nahcolite and hydrocarbon without departing from the spirit and scope of the present invention.

Accordingly, it is a principal feature of the present invention to provide a method of reducing the sulfur and nitrogen content of a hydrocarbon product, wherein the sulfur and nitrogen content of the hydrocarbon product is reduced by contact of the hydrocarbon product with nahcolite;

It is a further feature of the present invention to provide a method for the reduction of the sulfur and nitrogen content of a hydrocarbon product containing sulfur and nitrogen impurities wherein the hydrocarbon product in the gaseous or liquid phase is contacted with nahcolite, with subsequent removal of the nahcolite, containing combined sulfur and nitrogen, from the hydrocarbon product;

it is yet a further feature of the present invention to provide a method for the reduction of the sulfur and nitrogen content of a hydrocarbon product, and, consequently, a reduction of the sulfur dioxide and $NO_x$ emissions upon combustion of the hydrocarbon product, wherein the sulfur and nitrogen content of the hydrocarbon product is reduced by contacting a liquid phase hydrocarbon with finely divided nahcolite and subsequently removing the nahcolite containing combined sulfur and nitrogen by filtration;

Yet a further feature of the present invention lies in the above method, wherein shale oil as the hydrocarbon product is contacted with nahcolite in a shale oil retort, whereby the shale oil in an aerosol or gaseous form contacts nahcolite with an accompanying reduction in the sulfur and nitrogen content of the shale oil.

Yet further features and advantages of the method of the present invention will become more apparent from the following more detailed description thereof.

DESCRIPTION OF PREFERRED EMBODIMENTS

The above features of the present invention and the advantages associated therewith are achieved in accordance with the present invention by contacting a hydrocarbon product, either in the liquid or gaseous phase, with nahcolite, the nahcolite being used in an amount effective to reduce the sulfur and nitrogen content of the hydrocarbon product. Nahcolite is readily available as a naturally occurring sodium bicarbonate. It is a white monoclinic mineral in abundant supply and is located with oil shale deposits. Therefore, the use of nahcolite in the method of the present invention allows the effective and economical reduction of the sulfur and nitrogen content of a hydrocarbon product in a manner not heretofore contemplated.

Any hydrocarbon containing sulfur and/or nitrogen impurities, the reduction of which is desirable, can be utilized in carrying out the method of the present invention. Generally, the hydrocarbon product is in the liquid or gaseous phase when contacted with the nahcolite. Representative examples of typical hydrocarbons include, for example, gasoline, naphtha, kerosene, fuel oil, gas oil, lubricating oil, shale oil, etc. These hydrocarbon products can be conveniently contacted with nahcolite in the liquid phase, or shale oil as a typical example can be contacted with nahcolite in a retort where the shale oil is in the form of an aerosol or gaseous phase. In effect, any and all hydrocarbon products, the reduction of the sulfur and/or nitrogen content of which is desirable, can be contacted with nahcolite in accordance with the present invention for the purpose of reducing the sulfur and nitrogen content thereof. Of course, the method of the present invention can be applicably utilized where the hydrocarbon contains only sulfur or only nitrogen impurities, to the exclusion of the other, and the expression "sulfur and nitrogen impurities" clearly embraces such embodiment.

The method of the present invention is carried out by contacting a hydrocarbon product, either in the gaseous or liquid phase, with nahcolite, the nahcolite being employed in an amount effective to reduce the sulfur and nitrogen content of the hydrocarbon product. This, of course, in turn reduces the sulfur dioxide and nitrogen oxide(s) emissions upon the combustion of the hydrocarbon.

The method of the present invention can be carried out in various manners; for example, the nahcolite in finely divided form can be simply mixed with a liquid hydrocarbon product, such as a fuel oil, and thereafter removed from the hydrocarbon product after allowing sufficient contact. The removal can be carried out, for example, by simply filtering the solids from the hydrocarbon product. While the nature by which the nahcolite effectively reduces the sulfur and nitrogen content of the hydrocarbon is not precisely known, it is presumed that the nahcolite is effective either in entering into a chemical reaction with the sulfur and nitrogen impurities of the hydrocarbon, generally sulfides, sulfates, nitrites and nitrates, either of straight chain or ring structure, or by a physical absorption of the sulfur and nitrogen impurities. The expression, "nahcolite containing combined sulfur and nitrogen", as used throughout this application, is meant to embrace either or both of the above possibilities, either a chemical reaction or physical absorption. The removal of the nahcolite containing combined sulfur and nitrogen from the hydrocarbon product, such as by filtration, effectively reduces the sulfur and nitrogen content of the hydrocarbon.

As an alternative to the above method, the sulfur and nitrogen content of a liquid hydrocarbon product can be reduced in accordance with the present invention by filtering the liquid phase hydrocarbon through nahcolite. This allows sufficient contact between the nahcolite and sulfur and nitrogen impurities in the hydrocarbon product to allow effective reduction. In accordance with this embodiment of the present invention, the nahcolite can be advantageously coated on conventional filter cloth or other filter means, so as to allow the desired contact.

A further specific area in which the method of the present invention finds particular applicability is in the reduction of the sulfur and nitrogen content of shale oil. In this embodiment, the contact between the shale oil and nahcolite is effectively achieved in a shale oil retort in which the shale oil is employed as a layer above or below the nahcolite in a moving or static heated zone. The shale oil vaporizes in the form of a gaseous phase, liquid phase mist, or aerosol, which, when in contact with the nahcolite, has its sulfur and nitrogen content reduced. The use of a shale oil retort is, of course, a typically proposed technique for obtaining oil from shale. The method of the present invention in such environment has the additional advantage that the production of oil and the reduction of the sulfur and nitrogen content thereof can be carried out simultaneously.

The amount of nahcolite which is employed in any of the above embodiments is variable over wide limits, and any amount of nahcolite effective to reduce the sulfur and nitrogen content of the hydrocarbon product can be advantageously utilized. Generally, however, advantageous results are found to occur when the amount of nahcolite employed is substantially stoichiometrically equivalent to the amount of sulfur and nitrogen impurities present in the hydrocarbon product. Due to the nature of most hydrocarbon products, an amount of nahcolite of from about 1 to about 20 percent by weight based upon the weight of the hydrocarbon product is effective in achieving the advantages of the present invention. Of course, slightly lesser or greater amounts than these can be employed where desired to achieve particular purposes.

In addition to the foregoing discussion which involves a contact of the hydrocarbon product with nahcolite and subsequent removal of the nahcolite containing combined sulfur and nitrogen, in certain environments, it may be advantageous to leave the nahcolite in the hydrocarbon product. Upon combustion of this hydrocarbon product, reduced sulfur dioxide and nitrogen oxide(s) emissions will occur, both from the standpoint of the combination of the nahcolite with the sulfur and nitrogen impurities, thereby reducing the sulfur and nitrogen which through combustion forms sulfur dioxide and nitrogen oxides, and by the absorption or chemical reaction of the nahcolite with any sulfur dioxide and nitrogen oxides which are formed during combustion. Of course, this embodiment can only be employed where the presence of insoluble solids in the combustible hydrocarbon can be tolerated.

The nahcolite employed in the method of the present invention is preferably used in the condition received from the mine or with partial refinement. However, it is preferred in accordance with the present invention that the nahcolite be utilized in particulate or finely divided form. Inasmuch as the chemical reaction or physical absorption carried out in accordance with the method of the present invention is presumed to be a surface reaction, a finely divided form of the nahcolite providing the greatest possible surface area is preferred. No limitation is placed upon the lower limit of particle size, except that resulting from the parameters of the filtering or other equipment utilized to remove the nahcolite with combined sulfur and nitrogen from the hydrocarbon product.

The method of the present invention will now be described by reference to the following examples, which examples are presented for purposes of illustration only, and the present invention cannot, under any circumstances, be deemed limited thereto.

EXAMPLE 1

In order to illustrate the effectiveness of nahcolite in reducing the sulfur content of a hydrocarbon, the sulfur content of pure thiophene was measured prior to and subsequent to the addition of ten percent nahcolite. The insoluble solids were also measured.

The samples were weighed into a cup used for combustion. The analysis indicated that the sulfur content of the pure thiophene was 36.6 percent with negligible insoluble solids. After the addition of 10 percent nahcolite to the thiophene and the filtering of the nahcolite from the thiophene, the sulfur content was 31.5 percent, with the insoluble solids removed being 8.2 percent of the composition. This, therefore, establishes that the nahcolite utilized was effective to remove 5.1 percent of the sulfur present in the thiophene.

EXAMPLE 2

A similar test was conducted utilizing No. 6 fuel oil. First, 25 grams of pure No. 6 fuel oil were analyzed. Then the same 25 grams of oil containing 5.625 grams of minus 65 mesh nahcolite were analyzed. The analysis included the total sulfur content, the insolubles content, and the sulfur content in insolubles. As a result of these analyses, the following results were obtained.

| | |
|---|---|
| (25 grams No. 6 fuel oil + 5.625 grams − 65 mesh nahcolite) | |
| Total sulfur (S) | 2.0 % |
| Insolubles | 17.8 % |
| Sulfur in insolubles | 0.16% |
| (pure No. 6 fuel oil) | |
| Total sulfur | 2.8 % |
| Insolubles | 0.74% |
| Sulfur in insolubles | 0.08% |

It can be seen from the above data that the addition of the nahcolite was effective to reduce the sulfur content of the fuel oil.

EXAMPLE 3

A similar experiment was conducted with fuel No. 2 oil. The sulfur contents of two samples to pure oil were 0.23 and 0.22 percent, respectively. One percent carbon disulfide and three percent carbon disulfide were added respectively to these oils, bringing the sulfur content up to 0.26 and 0.66 percent, respectively. Also, one percent thiophene and three percent thiophene were added respectively to these oils, bringing the sulfur content of the pure oil containing thiophene up to 0.76 and 1.1 percent, respectively. When nahcolite was added to both the oil containing carbon disulfide and oil containing thiophene, approximately 70 to 90 percent of the sulfur was removed.

While the present invention has been described primarily with regard to the foregoing exemplification of specific embodiments, it should be understood that the present invention cannot, under any circumstances, be deemed limited thereto, but rather must be construed as broadly as any and all equivalents thereof.

What is claimed is:

1. A method for reducing the sulfur and nitrogen content of a hydrocarbon containing sulfur and nitrogen impurities which comprises:

a. contacting said hydrocarbon in the liquid or gaseous phase with nahcolite in an amount effective to remove sulfur and nitrogen impurities from said hydrocarbon; and b. removing the nahcolite containing combined sulfur and nitrogen from said hydrocarbon.

2. The method of claim 1, wherein said hydrocarbon is shale oil and said shale oil and nahcolite are contacted in a shale oil retort.

3. The method of claim 1, wherein said hydrocarbon is in the liquid phase and said nahcolite containing combined sulfur and nitrogen is removed by filtration.

4. A method of reducing the sulfur and nitrogen content of a liquid phase hydrocarbon containing sulfur and nitrogen impurities which comprises filtering said liquid phase hydrocarbon through nahcolite.

5. The method of claim 4, wherein said nahcolite is coated on a filter.

6. A method of reducing sulfur dioxide and nitrogen oxide(s) emissions in the combustion of a combustible hydrocarbon containing sulfur and nitrogen impurities, which comprises contacting said combustible hydrocarbon in the liquid or gaseous phase prior to combustion with nahcolite, in an amount effective to appreciably reduce sulfur dioxide and nitrogen oxide(s) emissions.

7. The method of claim 6, wherein said combustible hydrocarbon is a fuel oil.

8. The method of claim 6, wherein said nahcolite is contacted with said combustible hydrocarbon in finely divided form.

9. The method of claim 6, wherein said nahcolite is contacted with said combustible hydrocarbon in an amount of from about one percent to about 20 percent by weight, based on the weight of the sulfur and nitrogen in the combustible hydrocarbon.

* * * * *